United States Patent [19]

Strok

[11] Patent Number: 4,599,543

[45] Date of Patent: Jul. 8, 1986

[54] TIME FUSE FOR HIGH PRESSURE SODIUM LAMPS

[75] Inventor: Jack M. Strok, Garrettsville, Ohio

[73] Assignee: General Electric Company, Schenectady, N.Y.

[21] Appl. No.: 822,931

[22] Filed: Jan. 27, 1986

Related U.S. Application Data

[63] Continuation-in-part of Ser. No. 542,246, Oct. 14, 1983, abandoned.

[51] Int. Cl.[4] ..... H01J 7/44; H01J 17/34; H01J 19/78; H01J 29/96

[52] U.S. Cl. ..... 315/73; 313/25; 315/56; 315/74; 337/159; 337/166

[58] Field of Search ..... 337/159, 166, 280, 290; 315/56, 71, 58, 73, 74; 313/25

[56] References Cited

U.S. PATENT DOCUMENTS

| | | | |
|---|---|---|---|
| 3,386,063 | 5/1968 | Mansfield, Jr. | 337/290 |
| 3,885,184 | 5/1975 | Schat et al. | 315/71 |
| 4,297,666 | 10/1981 | Asdollahi | 337/290 |
| 4,382,205 | 5/1983 | Strok, Jr. | 313/25 |
| 4,415,836 | 11/1983 | De Cuester et al. | 337/290 |
| 4,500,811 | 2/1985 | McMillan | 337/290 |

*Primary Examiner*—Saxfield Chatmon

*Attorney, Agent, or Firm*—John P. McMahon; Philip L. Schlamp; Fred Jacob

[57] ABSTRACT

A high pressure sodium vapor lamp having a time fuse device effective for predeterminedly establishing the anticipated life of the high pressure lamp is disclosed. Also disclosed are various embodiments of the time fuse device.

7 Claims, 3 Drawing Figures

TIME FUSE FOR HIGH PRESSURE SODIUM LAMPS

This application is a continuation-in-part, of application Ser. No. 542,246, filed 10/14/83, now abandoned.

BACKGROUND OF THE INVENTION

This invention relates to high intensity discharge lamps utilizing a time fuse device, and more particularly, to a high pressure sodium vapor lamp having a time fuse device arranged within the lamp so that the life of the HPS lamp is predeterminedly established.

High pressure sodium vapor lamps have been widely used during the past decade for commercial lighting applications, especially outdoor lighting. Such lamps are described in U.S. Pat. No. 3,248,590 of Schmidt, entitled "High Pressure Sodium Vapor Lamps" and which is assigned to the same assignee as the present invention. High pressure sodium lamps typically utilize a slender, tubular inner envelope formed of a light-transmissive refractory oxide material which is resistant to sodium at high temperatures and which is advantageously a high density polycrystalline alumina ceramic. The ceramic arc tube is generally supported within an outer vitreous envelope or jacket provided at one end with the usual screw base. The electrodes in the inner envelope are connected to terminals of the base, that is to shell and center contacts. The space between the inner and outer envelopes is typically evacuated in order to conserve heat.

High pressure sodium lamps typically manifest a normal long term failure termed "lamp cycling" due to lamp voltage rise with time. This lamp cycling can cause the lamp to operate intermittently, resulting in a failure mode which is highly annoying to anyone trying to perform a task under the lamp. Inasmuch as lamp cycling may occur only once every several minutes, lamps in need of replacement manifesting a lamp cycling failure on highways are difficult to spot without a great deal of monitoring time.

In addition to lamp cycling failure, high pressure sodium (HPS) lamps may burn well beyond their rated life at efficiencies less than 70% of their initial value. The operation of HPS lamps below their rated efficiency is disadvantageous in that the lumen output thereof is less than desired and over a prolonged period of time such operation is not cost effective.

It is desired that the long term failure mode of lamp cycling be reasonably predicted and the efficient operation of the HPS lamps be predeterminately established so that appropriate replacement procedures may be implemented to eliminate the bothersome and inefficient operation of HPS lamps.

Accordingly it is an object of the present invention to provide means to eliminate the operation of cycling HPS lamps operating in a cycling failure mode and at efficiencies less than desired.

This and other objects of the present invention will become more apparent upon consideration of the following description of the invention.

SUMMARY OF THE INVENTION

This invention is directed to high pressure sodium (HPS) lamps having a time fuse device for predeterminately establishing the life of the HPS lamps. The high pressure metal vapor lamp comprises an outer vitreous envelope having a pair of sealed lead-in conductors. An arc tube is supported within the outer envelope and has one of its ends connected to one of the lead-in conductors. The lamp further comprises a time fuse device having a fusible element affixed within a housing and connected between the other end of the arc tube and the other of the lead-in conductors. The fusible element has predetermined time fuse characteristics established by being formed with preselected dimensions and of materials effective to cause it to rupture within a predetermined time duration corresponding to the anticipated life expectancy of the HPS lamp.

The present invention may best be understood by reference to the following description of the drawing and detailed description of the preferred embodiments.

DETAILED DESCRIPTION OF THE PREFERRED EMBODIMENTS

Figure 1:
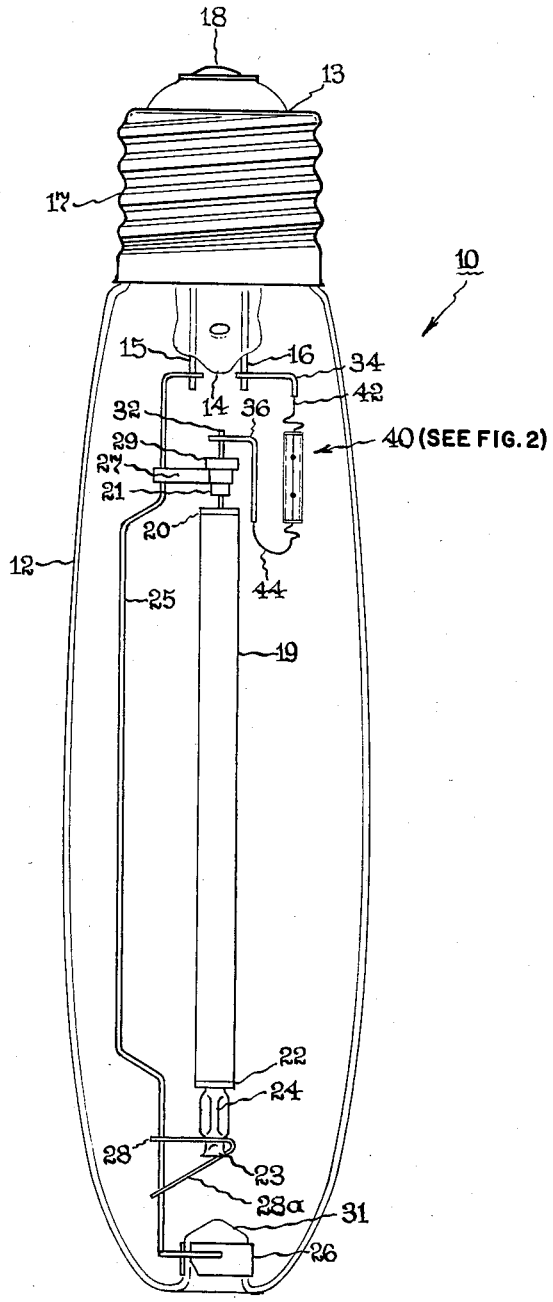
FIG. 1 is a front elevational view of a high pressure sodium vapor lamp according to the present invention.

A high pressure sodium (HPS) vapor lamp 10 according to one embodiment of the present invention and having a typical value such as 250 watts is illustrated in FIG. 1. The HPS vapor lamp 10 comprises a vitreous light-transmissive outer envelope 12 with a standard mogul base 13 attached to a stem 14 which is shown in the upper portion of FIG. 1. The stem 14 has a pair of relatively heavy sealed lead-in conductors 15 and 16 extending therethrough and having outer ends connected to a screw base 17 and eyelet 18 of the base 13.

The HPS lamp 10 includes an inner envelope or arc tube 19 centrally located and longitudinally supported within the outer envelope 12. The arc tube 19 may contain a charge of vaporable metals having a sodium partial pressure in the range of about 20 to 500 torr and a xenon gas in the range of about 10 to 500 torr. The arc tube 19 is comprised of a length of light-transmitting polycrystalline alumina ceramic which is translucent. The upper end of arc tube 19 is closed by an alumina ceramic sealing plug 20 through which extends hermetically a niobium inlead 21 which supports an upper electrode (not shown) within the arc tube 19. The lower end of the arc tube 19 has a closure which comprises a ceramic sealing plug 22 through which extends a thin walled niobium tube 23. The ceramic sealing plugs 20 and 22 are described in greater detail in U.S. Pat. No. 4,065,691—McVey, Ceramic Lamps Having Electrode Support by Crimp Tubular Inleads.

The niobium tube 23 serves both as an inlead for arc tube 19 and as a reservoir for storing excess alkali metal and mercury contained within the arc tube 19. The shank of the lower electrode of arc tube 19 projects into reservoir tube 23 and is locked in place by crimping the niobium reservoir tube about the upper end at location 24. The niobium reservoir tube 23 is electrically connected to a metal frame 25 by appropriate means such as spot welding to a cross member 28 having a lower curved portion 28*a* as shown in FIG. 1. Cross member 28 also provides mechanical support for the arc tube 19. The members 28 and 28*a* may be of the type described in my U.S. Pat. No. 4,382,205 issued May 3, 1983 with regard to members 19 and 19*a*, respectively, and which U.S. Patent is assigned to the same assignee as the present invention.

The metal frame 25 is a relatively heavy lead-in conductor and has one of its ends connected to inlead 15 The other end of metal frame 25 is fixed in place within the envelope 12 by a clamp 26 attached to the dimpled dome 31 of the envelope 12. The metal frame 25 provides support for arc tube 19 within the envelope 12 by cross-support member 27.

Figure 2:
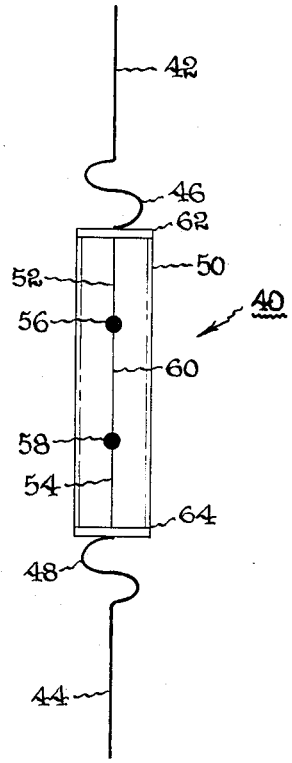
FIG. 2 is an exposed enlarged view, showing the time fuse device of the present invention.

The other end of arc tube 19 has a niobium inlead 32 and is connected to inlead 16 by elements 34, 36, and 40. The elements 34 and 36 are of a relatively heavy type of inlead construction and interpose element 40 between inlead 16 and arc tube 19 via inlead wires 42 and 44 of element 40, respectively. Element 40 is a time fuse device and is shown in detail in FIG. 2.

The time fuse device 40 comprises an electrically insulating, refractory tubular housing 50 formed of a ceramic material such as glass or preferably aluminum oxide ceramic. The ceramic housing 50 surrounds a fusible element 60, to be described, and prevents evaporation products created by the fusible element 60 from condensing on the envelope 12 and thus substantially prevents the time fuse device from decreasing the lumen output of the HPS lamp 10. The ceramic tube 50 is provided with end covers or baffles 62 and 64 located at opposite ends thereof and is preferably hermetically sealed.

The ceramic tube 50 may have dimensions such, for example, as a wall thickness of 1 mm, a length of 20 mm, and an inner diameter of 10 mm. The inner diameter and length of ceramic tube 50 is selected to be substantially greater than the diameter and length of fusible element 60 in order that a current within time fuse device 40 does not flow along the inner surfaces of tube 50.

The ceramic tube 50 may be held positioned with respect to fusible element 60 by bends 46 and 48 in inleads 42 and 44, respectively abutting against opposite ends of the tube 50. The inlead wires 42 and 44 have further portions 52 and 54, respectively, which are respectively connected to welds 56 and 58. The inlead wires 42 and 44, along with their portions 46, 52, 48 and 54 are of a suitable wire size such as 0.9 mm (0.035 inches) diameter. The lead wires 42 and 44 along with their portions 46, 52, 48 and 54 are formed suitably of a nickel or niobium metal having low vapor pressure. The nickel or niobium metal facilitates the joining of portions 52 and 54 to fusible element 60.

The fusible element 60 is affixed between welds 56 and 58. The fusible element 60 is formed of a metal composition selected from the group consisting of silver, aluminum, copper, and alloys thereof. The fusible element 60 has further characteristics selected such that its ohmic value provides for a negligible voltage drop during normal operation of the HPS lamp 10 but by the end of the desired lamp life of HPS lamp 10 enough of the metal forming fusible element 60 has evaporated so that fusible element 60 ruptures at a predetermined time duration and the life of the HPS lamp 10 is terminated.

The predetermined rupturing duration of fusible element 60 is determined by the dimensional parameters and metal composition of the fusible element 60 and the temperature at which the fusible element 60 normally operates. Normally the environment of fusible element 60 within HPS lamp 10 has a temperature between about 200° C. and 700° C., depending on its proximity to the arc tube. The selected compositions of fusible element 60 have vapor pressures which when the element is subjected to the temperatures within the HPS lamp cause the fusible element 60 to rupture at the anticipated life of HPS lamp 10.

The parameters related to the fusible element 60 may be determined by first considering the vacuum evaporation for metals. The vacuum evaporation rate for metals is given approximately by the following relationship:

$$G = 5.85 \times 10^{-2} P \sqrt{\frac{A}{T}}, \quad (1)$$

where

G is in grams/cm$^2$ sec

P=Vapor pressure in Torr

A=Atomic weight

T=Temperature in degress Kelvin

The mass loss of a cylindrical wire of a diameter D and a length L in time increment $\Delta t$ may be either given as $\pi DLG\Delta t$ or, in terms of the wire density $\delta$, as $\pi\delta DL\,D/2$. By equating these expressions of mass loss, it is revealed that the wire diameter decreases linearly with time. The time in seconds to completely evaporate fusible element 60 at a constant temperature may be expressed as:

$$t = \frac{\delta D}{2G} = \frac{\delta D}{.117P} \times \sqrt{\frac{T}{A}} \quad (2)$$

As a specific example related to expressions (1) and (2), the element silver may be chosen. The vapor pressure of silver as a function of temperature may be expressed as;

$$\mathrm{Log}_{10} P = -14058/T + 8.865 \quad (3)$$

The atomic weight of silver is 107.9, its density is 9.3 and when considered with regard to expressions (1), (2) and (3), one can calculate the initial wire diameter of the fuse element required to evaporate completely in 24000 hours as a function of its steady state operating temperature. From expressions (1), (2) and (3) and by using a steady state operating temperature in the range of 590° C. to 640° C. calculated wire diameters in the range of about 5.5 mils to about 43 mils are yielded for a fusible element 60 related to high pressure vapor lamp having an anticipated life expectancy of 24,000 hours. The temperature range from 590 to 640 degrees is readily obtained by varying proximity of the fusible element to the arc tube, and the range of wire sizes is consistent with current carrying requirements, yet not so large that the mass of evaporated material over lamp life is excessive.

The calculated values must be considered with regard to the operating environment in which the fusible element may be housed. As a practical matter, the fusible element 60 ruptures due to lamp inrush current at some finite diameter when ohmic power losses raise the fusible element to its melting point. The ohmic power losses in the fusible element may be expressed as;

$$W=I^2R=I^2L/(\pi D/2)^2, \quad (4)$$

where

W is in watts

I is lamp current in amperes

R is fuse wire resistance in ohms $\rho$ is the fuse wire resistivity in ohm-cm

L is the length of the fuse wire in cm

D is the diameter of the fuse wire in cm

The steady state temperature of the fusible element may be determined by the Stefan-Boltzmann law expressed as;

$$W=\sigma\epsilon(\pi DL)T^4, \quad (5)$$

where $\sigma$=Stefan-Boltzmann Constant=$5.67\times10^{-12}$ W/cm$^2$ °K$^4$ $\epsilon$=wire emissivity T=wire temperature in °K.

Equating expressions (4) and (5) yields an expression for the wire diameter at a given current which just melts by ohmic losses given as follows;

$$D=\frac{4\rho\, I^{2\frac{1}{3}}}{\pi^3\,\sigma\epsilon T m^4}, \quad (6)$$

where $T_m$ is the melting point of the metal in °K.

For the specific example of silver, $\rho=5\times10^{-6}$ ohm-cm at the melting point $T_m$=1235° K., and $\epsilon$=0.12 and from which values yields the following relationship;

$$D=7.4\times10^{-3}\, I^{\frac{2}{3}}\ \text{cm}, \quad (7)$$

or $$D=2.9\, I^{\frac{2}{3}}\ \text{mils} \quad (8)$$

Considering that typical HPS lamp types between 35 watts and 400 watts have starting currents in the range of 1 to 7 amperes; therefore, D may range from 3 to 11 mils. These values are approximate in that both surface conditions of the fusible element and heat sinking effects to the inleads of the HPS lamp may lower these values. Practical diameters of silver fuse elements for 24,000 hours of operation are sized more than 2.9 $I^{\frac{2}{3}}$ mils larger than the calculative values in the range of about 5.5 mils to about 43 mils in order to account for the ohmic dissipation over lamp life. The diameter of the fusible element comprised of silver is in the range of about 8.5 mils to about 54 mils for HPS lamp types between 35 watts and 400 watts having an anticipated life of 24,000 hours.

The fusible element 60 provides the means for eliminating problems related to the HPS lamp art. More specifically, and as discussed in the "Background" section, the HPS lamps typically manifest a long term failure mode termed lamp cycling. This bothersome lamp problem is difficult to detect in that it can have a duration on the order of several minutes.

Additionaly, and as further discussed, HPS lamps after a prolonged period of time may operate with a lumen output lower than desired and less than 70% of its initial value. The time fuse device 40 of the present invention obviates both of these bothersome problems.

The time fuse device 40 prevents HPS lamp 10 operation after a predetermined time. The fuse device 40 having the fusible element 60 ruptures at a predetermined time causing the removal of electrical excitation to the arc tube 19 and HPS lamp 10 becomes inoperative. The termination of the operation of HPS lamp 10 at a predetermined time provides the users of HPS lamps with prior knowledge that may be predeterminately factored into their HPS lamp 10 replacement procedures so as to eliminate the bothersome lamp cyclying failures and ineffective operation of the HPS lamps.

Figure 3:
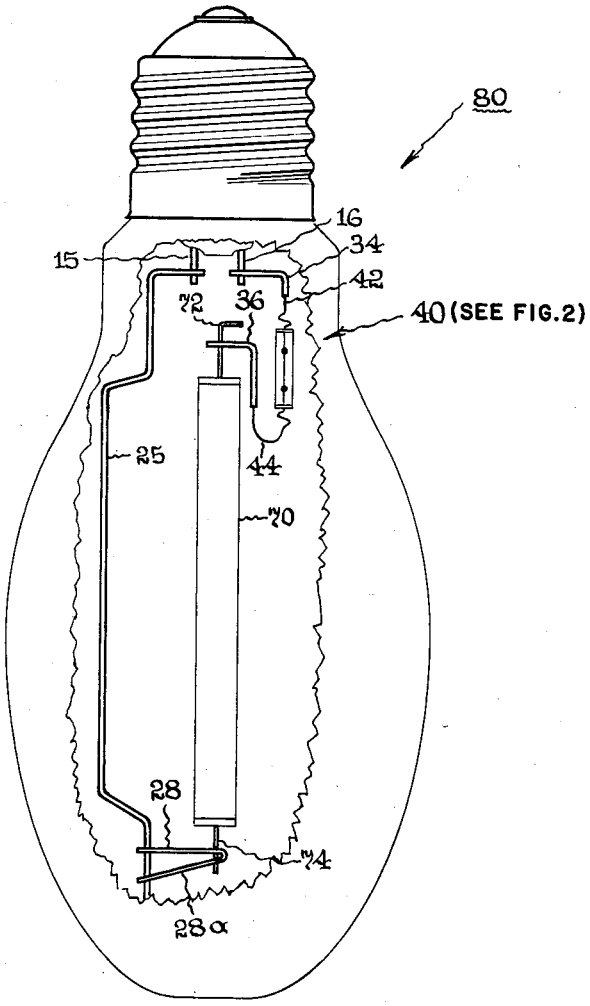
FIG. 3 is a high pressure sodium (HPS) vapor lamp of the double wire arc tube partially broken away to show the present invention applied therein.

A further embodiment of the present invention having the time fuse device 40 is related to a double-wire arc tube 70 centrally located within a HPS vapor lamp 80 of FIG. 3. The double-wire arc tube 70 is shown in a partially exposed illustration of the HPS lamp 80 of FIG. 3. The arc tube 70 may be preferably formed of a polycrystalline alumina and has two oppositely located inleads 72 and 74 formed of niobium wire. The arc tube 70 may have an oxygen getter of the type described in my U.S. patent application Ser. No. 465,933, filed Feb. 14, 1983 to which reference may be made for further details of internal structure of arc tube 70.

The inleads 72 and 74 are respectively connected to conductor 36 and cross member 28 both described for the HPS lamp 10 of FIG. 1. The time fuse device 40 is connected between the inlead 72 and the sealed lead-in 16. The time fuse device 40 having the fusible element 60 operates in a manner as described in reference to FIGS. 1 and 2 and is effective to rupture within a predetermined time duration corresponding to the anticipated life expectancy of the HPS vapor lamp 80 of FIG. 3.

Although the time fuse device 40 has been described with regard to HPS vapor lamps 10 and 80, it should be recognized that the practice of this invention contemplates the use of the time fuse device 40 with other high pressure vapor lamps. For the time fuse device 40 to perform its desired function its fusible element 60 is adapted, by appropriate preselected dimensions and material composition, to have a time fuse characteristic which adapts it to rupture within a predetermined time duration corresponding to the desired operating life expectancy of the lamp in which it is applied.

It should now be appreciated that the practice of the present invention provides an improved high pressure sodium lamp having means effective to predeterminedly establish the life expectancy of the lamp.

What I claim as new and desire to secure by Letters Patent of the United States is:

1. In a high pressure vapor lamp having:

an outer vitreous envelope including a pair of sealed lead-in conductors, an arc tube supported within said outer envelope and having one of its ends connected to one of said lead-in conductors, the improvement comprising:

a time fuse device including an electrically conductive fusible element supported within a housing and serially connected between the other end of said arc tube and the other of said lead-in conductors, said fusible element having a time fuse characteristic established by preselected dimensions and material adapting it to rupture within a predetermined time duration corresponding to the anticipated life expectancy of the lamp.

2. In a high pressure vapor lamp according to claim 1 wherein said fusible element is a metal composition selected from the group consisting of silver, aluminum, copper, and alloys thereof.

3. In a high pressure vapor lamp according to claim 1 wherein said housing of said time fuse device is of an electrical insulative refractory material formed of an aluminum oxide ceramic.

4. In a high pressure vapor lamp according to claim 3 wherein said housing is positioned relatively close to said arc tube.

5. In a high pressure vapor lamp according to claim 1 wherein said housing of said time fuse device has covers at opposite ends and is hermetically sealed.

6. In a high pressure vapor lamp according to claim 1 wherein said time fuse device is supported by first and second looped portions interconnecting said fusible element to said lead-in conductor and said arc tube, said first and second loop portions located and abutting opposite ends of said housing.

7. In a high pressure vapor lamp according to claim 1 wherein said fusible element is of a silver composition and has a diameter in the range of about 8.5 mils to about 54 mils and said high pressure vapor lamp has a wattage rating in the range of 35 watts to 400 watts with an anticipated life of about 24,000 hours.

* * * * *